US007491159B2

(12) United States Patent
Patterson

(10) Patent No.: US 7,491,159 B2
(45) Date of Patent: Feb. 17, 2009

(54) REVERSIBLE RESISTANCE ASSEMBLY FOR HYDRAULIC EXERCISE APPARATUS

(76) Inventor: Gary W. Patterson, 1061 S. Emerson, Denver, CO (US) 80209

( * ) Notice: Subject to any disclaimer, the term of this patent is extended or adjusted under 35 U.S.C. 154(b) by 704 days.

(21) Appl. No.: 10/903,204

(22) Filed: Jul. 30, 2004

(65) Prior Publication Data

US 2006/0025288 A1 Feb. 2, 2006

(51) Int. Cl.
*A63B 21/008* (2006.01)

(52) U.S. Cl. ..... 482/112; 482/137

(58) Field of Classification Search ..... 482/72, 482/73, 92, 111–113, 121, 129, 130, 136, 482/96, 137
See application file for complete search history.

(56) References Cited

U.S. PATENT DOCUMENTS 4,576,377 A * 3/1986 Wolff ..... 482/113
5,058,887 A * 10/1991 Patterson ..... 482/113
5,217,422 A * 6/1993 Domzalski ..... 482/138
5,330,406 A * 7/1994 Patterson ..... 482/113
5,409,440 A * 4/1995 Yang ..... 482/138
5,584,785 A * 12/1996 Wu ..... 482/95
5,605,524 A * 2/1997 Husted ..... 482/112
5,643,147 A * 7/1997 Huang ..... 482/72
5,785,635 A * 7/1998 Gerschefske et al. ..... 482/133
6,641,509 B1 * 11/2003 Chen ..... 482/94
6,971,978 B2 * 12/2005 Hyder ..... 482/142
2005/0101464 A1 * 5/2005 Campitelli ..... 482/142

FOREIGN PATENT DOCUMENTS

GB 2146910 A * 5/1985
JP 05076620 A * 3/1993
WO WO 9014132 A1 * 11/1990

* cited by examiner

*Primary Examiner*—Loan H Thanh
*Assistant Examiner*—Victor K Hwang
(74) *Attorney, Agent, or Firm*—J. Preston Oxenham

(57) ABSTRACT

A resistance assembly for a hydraulic resistance exercise apparatus includes a single-action hydraulic cylinder having a longitudinal axis and extending from a first end to a second end. The single-action cylinder provides resistance to compression of the cylinder, one end toward the other, but provides little or no resistance to extension of the cylinder, one end away from the other. A first compression linkage compresses the hydraulic cylinder in response to movement of a first exercise resistance lever in a first direction. A second compression linkage compresses the hydraulic cylinder in response to movement of a second exercise resistance lever in a second direction directly opposed to the first direction. An engagement exercise lever includes an engagement pin for selectively engaging the engagement exercise lever to move in fixed relation to one or the other the first or second exercise levers in both the first and second direction.

19 Claims, 3 Drawing Sheets

REVERSIBLE RESISTANCE ASSEMBLY FOR HYDRAULIC EXERCISE APPARATUS

TECHNICAL FIELD

The present invention relates to apparatus to facilitate the exercising of muscles for cardiovascular and aerobic exercise and to enhance muscle development. More specifically, the present invention relates to apparatus for providing resistive forces against which muscles of the human body may be dynamically exercised in a variety of exercise patterns to selectively enhance their growth and development. Most particularly the present invention relates to such exercise devices which provide such resistive forces by means of a single-action hydraulic cylinder.

BACKGROUND OF THE INVENTION

In recent years, increased recognition of the many benefits of cardiovascular and aerobic exercise and body conditioning, in combination with continually increasing time constraints of modern lifestyles have resulted in a large demand for exercise devices which can provide maximum benefits of exercise with a minimum of inconvenience and minimum time requirement. This demand has resulted in the development of numerous types of exercise machines and systems.

Exercise machines and systems may be categorized based upon the method and medium utilized to provide a resistive force against which the muscles are worked and the configuration of the structural elements of the apparatus through which the user athlete interfaces with the resistive medium. Prior to the advent of modem exercise machines and universal gyms, iron weights lifted against gravity were the most common resistance medium. There is an ever present danger associated with the use of such free weight equipment that a user athlete will lose control of the weight due to fatigue of the athlete's muscles or an attempt to lift more weight than the athlete's muscles are capable of controlling. Much time is required for changing weights and moving weights and auxiliary equipment to prepare for different exercises. Many contemporary exercise and universal gym devices continue to use iron weights, or weights made of other suitably dense material, to provide resistance for muscle exercise while attempting to overcome the dangers and inconvenience of free weight exercise apparatus. These devices confine the weights to movement along fixed tracks to eliminate dangers associated with loss of control and dropping of free weights during attempts to work the muscles against too great a force. The weights of these apparatus are connected by chains, levers and the like, in various configurations, to exercise members which are engaged and worked in a cyclical fashion during muscle conditioning exercises by the user athlete. These machines, however, also suffer from a number of disadvantages. First, they must be massive to provide the weight necessary for training advanced athletes and to provide the structural strength necessary to support and control that weight. Also, they are complex because all exercising motions must be translated into up and down movement of the weights along their tracks in the gravitational field.

Efforts to reduce the great mass associated with weight resistance devices and to free the design of exercise machine and universal gym structures from the constraints of orienting the movement of the resistance medium to an alignment with gravity have lead to the development of a number of exercise devices based upon hydraulic resistance. While machines of this type differ in their hydraulic system design and their structural configuration for providing the interface between the user athlete and the hydraulic resistance system, the hydraulic systems of all these apparatus generally have two key elements in common; a hydraulic cylinder with a piston linked to an exercise member and arranged to pump fluid in and out of the cylinder in response to movement of the exercise member through an exercise cycle, and a static and/or dynamic flow resistance means for creating a resistive pressure in the cylinder against which the muscles are worked.

Most hydraulic exercise apparatus heretofore known in the art utilize double-action hydraulic cylinders. The utilization of double-action hydraulic cylinders in many of these devices results in multi-directional resistance. That is, unlike exercise with free weights, exercising forces are provided by double-action cylinder devices which resist movement of the exercise member during both an exercise stroke and a return stroke of an exercise cycle. Due to this "two-way resistance", these devices fail to provide the benefits of muscle exercise which may be obtained with "free weight" exercising apparatus which do not provide a resisting force during the return stroke. Double-action cylinders are more complex and costly than single-action hydraulic cylinders, and are generally weaker than single-action hydraulic cylinders of similar cost and size. Thus, in devices using double-action cylinders, the cylinders must be located further from fulcrum points requiring larger structures than can be provided by exercise devices utilizing single-action cylinders.

Many hydraulic exercise devices of the present art also lack sufficient configuration adaptability to provide a full range of individual muscle toning exercises necessary for true muscle conditioning program versatility. Many of these machines utilize designs requiring the use of multiple single-action hydraulic cylinders in order to allow a reasonable number of different exercises to be accomplished with the aid of only that single machine, further increasing its mass and complexity. In U.S. Pat. No. 5,058,887; this inventor disclosed a hydraulic exercise apparatus utilizing a single-action hydraulic cylinder which provided a great variety of exercises to be performed with a simple and versatile exercise resistance assembly. However, this assembly required removal from and reattachment to the exercise resistance assembly for certain exercise devices to achieve reversal of the exercise resistance force direction.

DISCLOSURE OF THE INVENTION

It is an object of the present invention to allow a hydraulic resistance exercise apparatus utilizing a single-action type hydraulic cylinder to provide a great variety of exercises while requiring only a minimum of effort to reconfigure the apparatus between exercise sets.

It is a further object of the present invention to provide a hydraulic resistance apparatus, utilizing a single single-action type hydraulic resistance cylinder, with the capability of quickly and relatively effortlessly being changed between two exercising sets which require a basic reversal of exercise resistance force direction.

It is a particular object of the present invention to eliminate the necessity of disconnecting an exercise device from one connection point on a single-action hydraulic cylinder resistance assembly of a hydraulic resistance exercise apparatus and connecting it to another connection point on the resistance assembly to achieve reversal of the exercise resistance force direction.

In keeping with the above objectives, a hydraulic resistance exercise apparatus comprising a reversible resistance assembly of the present invention has vertical support members with an upper and a lower hydraulic resistance assembly vertical support member attachment point. An upward exercise resistance force lever has one end attached to the lower support member attachment point and extends to an upward exercise resistance force end. A downward exercise resistance force lever extends from a linkage end to a downward exercise resistance force end and is attached to the support members at the lower support member attachment point at a point between the downward exercise resistance force lever end and linkage lever end. An upper linkage member has a linkage end and a resistance member mounting end and is attached to the support members at the upper support member attachment point, at a point between the linkage lever end and resistance member mounting lever end. A vertical linkage member extends from a lower end, which is attached to the downward exercise resistance force lever linkage end, to an upper end, which is attached to the upper linkage member linkage end. A vertically arranged single-action hydraulic cylinder, which provides resistance to compression of its ends but which provides little resistance to extension of its ends, is mounted vertically between a pivotal mount at the resistance member mounting end of the upper linkage lever and a pivotal mount near the exercise end of the upward exercise resistance force lever. Upper and lower stops prevent movement of the resistance mounting end of the upper linkage lever above a predetermined point and movement of the exercise end of the upward exercise resistance force lever below a predetermined point. Biasing springs urge the resistance member mounting end of the upper linkage lever to remain adjacent the upper stop and the upward exercise resistance force end of the upward force resistance lever to remain adjacent the lower stop.

An exercise engagement lever has a bifurcated mounting end mounted to the support members at the lower support member attachment point and extends to an exercise device attachment end which may be attached to an exercise device. The bifurcations of the mounting end of the exercise engagement lever embrace the upward exercise resistance force end of the upward exercise resistance force lever and the exercise force end of the downward exercise resistance force lever. Engagement holes are provided in the mounting end bifurcations and the exercise resistance force ends of the upward and downward exercise resistance force levers such that, the exercise engagement lever may be selectively engaged to move in locked relation to either of the upward or downward exercise resistance force levers by insertion of an engagement pin through the engagement holes of the bifurcated end and one of the exercise force ends. Thus, an exercise device may be attached to the end of the engagement lever and the engagement lever engaged with either of the upward or the downward exercise resistance force levers to selectively provide an upward or downward exercise resistance force for the exercise device.

Other objects, advantages and aspects of the invention will become apparent upon perusal of the following detailed description and claims and upon reference to the accompanying drawings.

DETAILED DESCRIPTION

The current invention is an improvement of the resistance assembly of the exercise apparatus of an earlier U.S. Pat. No. 5,058,887 to this inventor.

Figure 1:
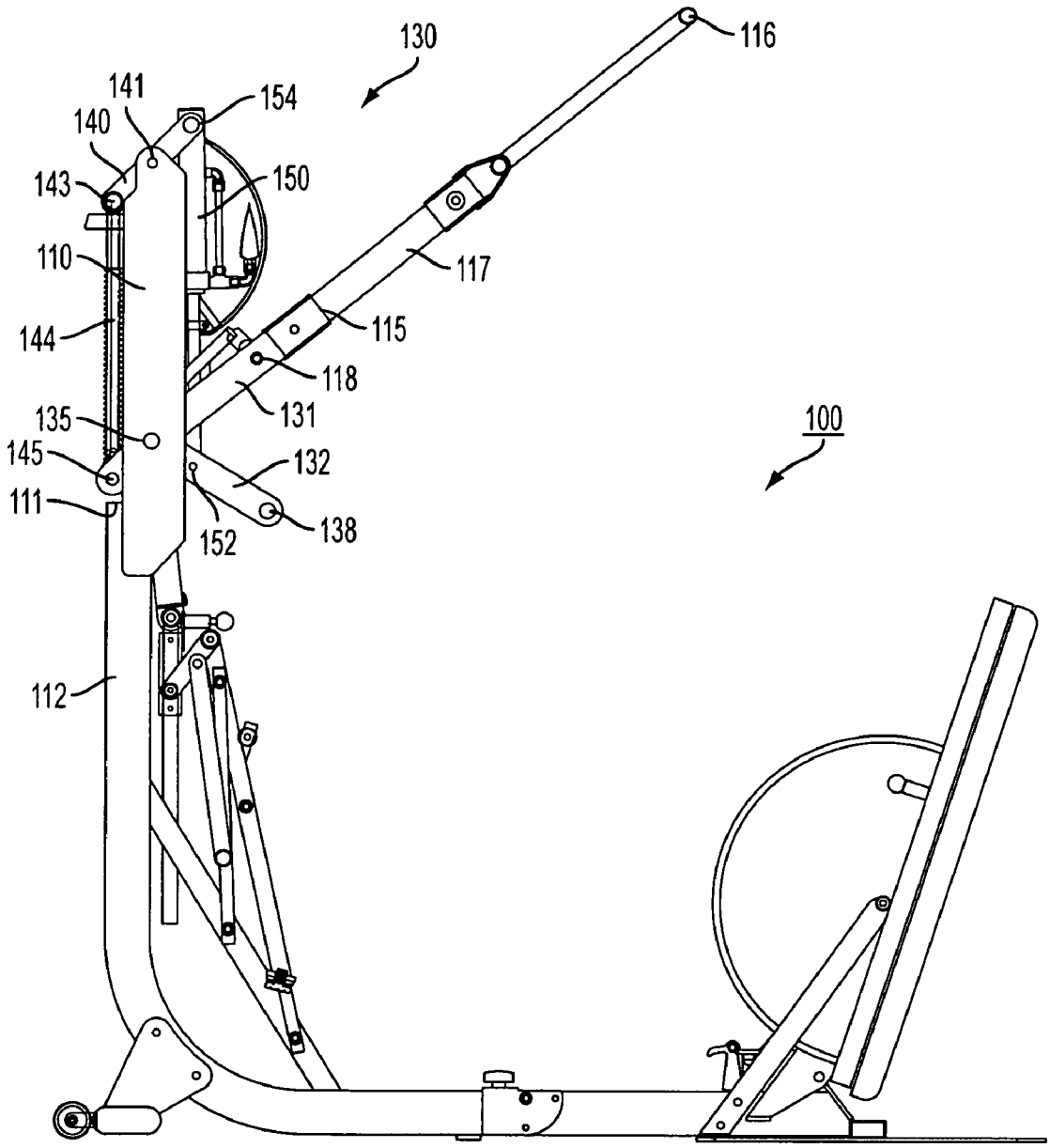
FIG. 1 is a side elevation of a single-action cylinder exercise apparatus including a reversible resistance assembly comprising a preferred embodiment of the present invention.
Figure 2:
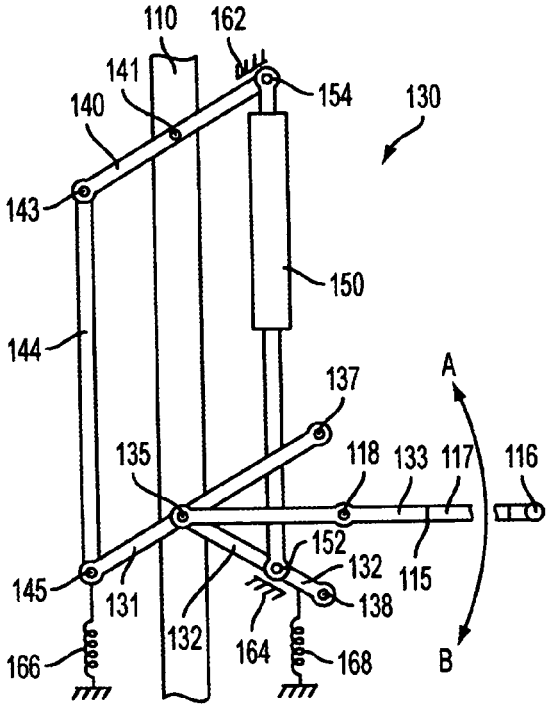
FIG. 2 is a schematic side elevation of a reversible resistance assembly of the present invention utilizing a single-action hydraulic resistance cylinder.

A side elevation of exercise apparatus 100 including exemplary reversible resistance assembly 130 comprising a preferred embodiment of the present invention is shown in side elevation in FIG. 1. FIG. 2 is a schematic side elevation of exemplary resistance assembly 130 of exercise apparatus 100 of FIG. 1.

Resistance assembly 130 includes downward exercise resistance force lever member 131 and upward exercise resistance force lever member 132, each attached to vertical support members 110 at lower pivotal vertical support member attachment point 135. Vertical support members 110 extend upward from mast cap 111 mounted at the top of mast 112. Engagement lever member 133 is also attached to support members 110 at pivot point 135. Extension member 117 is inserted into engagement lever member 133 at attachment point 115 and supports exercise device 116, upon which exercising forces may to be exerted by a user, at its distal end. As shown by the arrow, upward and downward forces exerted upon exercise device 116 may result in upward motion "A" and downward motion "B", respectively, of exercise device 116.

A hydraulic compression resistance member, single-action hydraulic cylinder 150, is mounted upon upward exercise resistance force lever member 132 at lower pivotal mounting point 152 and mounted upon upper linkage member 140 at upper pivotal mounting point 154. Single-action hydraulic cylinder 150 resists compression of its lower end at mounting point 152 and its upper end at mounting point 154 along its longitudinal axis, one toward the other, while allowing generally free extension of its lower end at mounting point 152 and its upper end at mounting point 154, one away from the other.

Upper linkage member 140 is attached to vertical support members 110 at upper vertical support member attachment point 141. Vertical linkage member 144 is attached to upper linkage member 140 at pivotal attachment point 143 and attached to downward exercise force lever member 131 at pivotal attachment point 145. Engagement lever member 133 is provided with engagement pin 118 which can selectively engage each of engagement openings 137 and 138 formed within downward exercise resistance force lever member 131 and upward exercise resistance force lever member 132, respectively.

Upper mounting point stop 162 limits rotation of upper linkage member 140 such that upper mounting point 154 cannot move above a position immediately adjacent to upper mounting point stop 162. Upper mounting point biasing element 166, which may be, for example, a spring, acts through vertical linkage member 144 to rotationally bias upper linkage member 140 to urge upper mounting point 154 to remain positioned immediately adjacent upper stop 162. Lower mounting point stop 164 limits rotation of upward exercise resistance force lever member 132 such that lower mounting point 152 cannot move below a position immediately adjacent to upward lower mounting point stop 164. Lower mounting point biasing element 168, which also may be, for example, a spring, acts upon upward exercise resistance force lever 132 to rotationally bias upward exercise resistance force lever 132 to urge lower mounting point 152 to remain positioned immediately adjacent lower mounting point stop 164.

Figure 3:
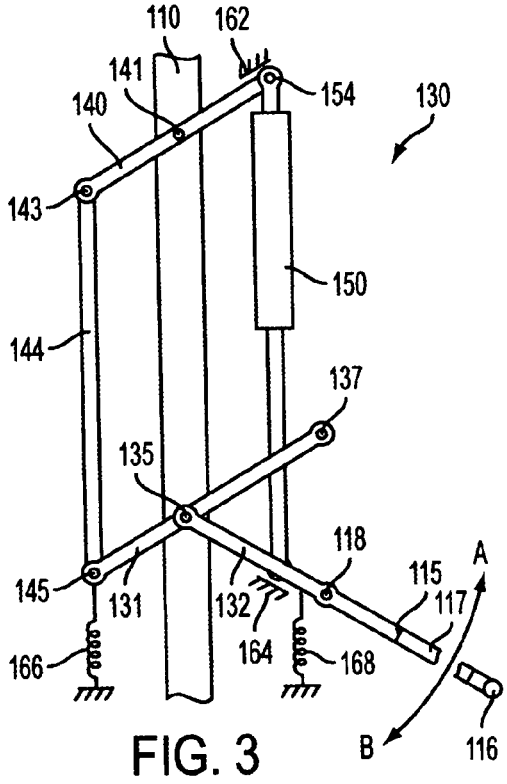
FIG. 3 is a schematic side elevation of a reversible resistance assembly of the present invention utilizing a single-action hydraulic resistance cylinder configured to provide upward exercise resistance force positioned at the beginning of an exercising stroke.
Figure 4:
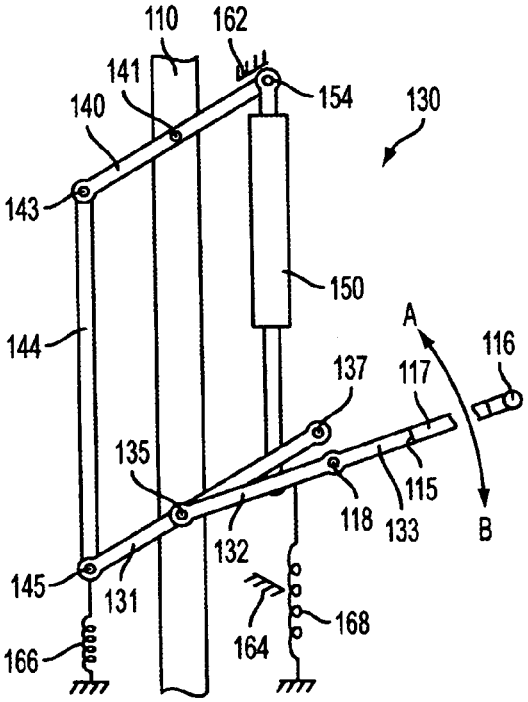
FIG. 4 is a schematic side elevation of a reversible resistance assembly of the present invention utilizing a single-action hydraulic resistance cylinder configured to provide upward exercise resistance force positioned at the end of an exercising stroke.

As shown in the schematic side elevation of FIG. 3, if a user wishes to exercise by exerting an upward force, in direction "A", on exercise member 116 attached to the distal end of extension member 117, the user configures the resistance assembly by engaging engagement pin 118 of engagement lever member 133 into engagement opening 138 of upward exercise resistance force lever member 132, such that upward force upon and movement of exercise member 116 is translated through extension member 117 and upward exercise resistance force lever 132 into upward force upon and movement of mounting point 152. Upward force upon mounting point 152 is translated through hydraulic cylinder 150 to mounting point 154 on upper linkage member 140. Movement of upper mounting point 154 is prevented by upper mounting point stop 162 and, thus, upward motion and resistance to upward motion of mounting point 152, and consequently exercise device 116, is determined by compression resistance characteristics of single-action hydraulic cylinder 150 during an upward exercise stroke to the position shown in the schematic side elevation of FIG. 4. Subsequent to completing an upward exercise stroke, in direction "A", exercise device 116 may be moved downward, in direction "B", to its initial position encountering little or no resistance. During such a return stroke, upper mounting point biasing element 166 maintains mounting point 154 in position immediately adjacent to upper mounting point stop 162.

Figure 5:
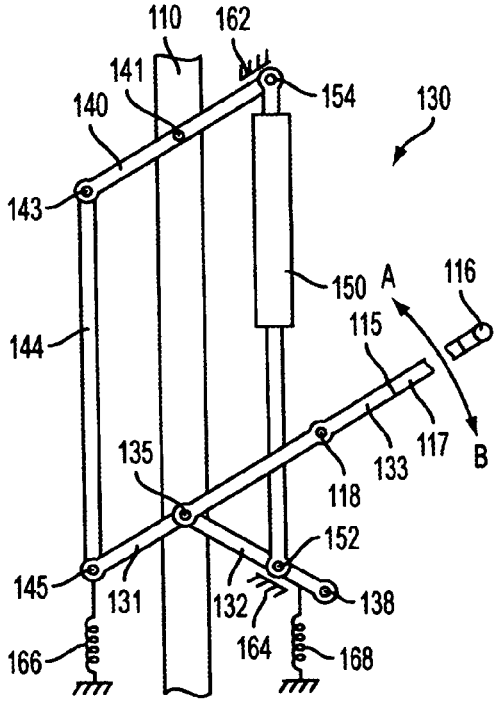
FIG. 5 is a schematic side elevation of a reversible resistance assembly of the present invention utilizing a single-action hydraulic resistance cylinder configured to provide downward exercise resistance force positioned at the beginning of an exercising stroke.

As shown in the schematic side elevation of FIG. 5, if a user wishes to exercise by exerting a downward force, in direction "B", on exercise member 116 attached to the distal end of extension member 117, the user configures the resistance assembly by engaging engagement pin 118 of engagement lever member 133 into engagement opening 137 of downward exercise resistance force lever member 131 such that downward force upon and movement of exercise member 116 is translated through extension member 117, downward exercise resistance force lever 131, vertical linkage member 144, and upper linkage member 140 into downward force upon and movement of upper mounting point 154. Downward force upon mounting point 154 is translated through hydraulic cylinder 150 to mounting point 152 on upward exercise resistance force lever 132. Movement of lower mounting point 152 is prevented by lower mounting point stop 164 and thus downward motion and resistance to downward motion of mounting point 154, and consequently exercise device 116, is determined by compression resistance characteristics of single action hydraulic cylinder 150 during a downward exercise stroke to the position shown in the schematic side elevation of FIG. 6. Subsequent to completing a downward exercise stroke, in direction "B", exercise device 116 may be moved upward, in direction "A", to its initial position encountering little or no resistance. During such a return stroke, lower mounting point biasing element 168 maintains mounting point 152 in position immediately adjacent to lower mounting point stop 164.

Figure 6:
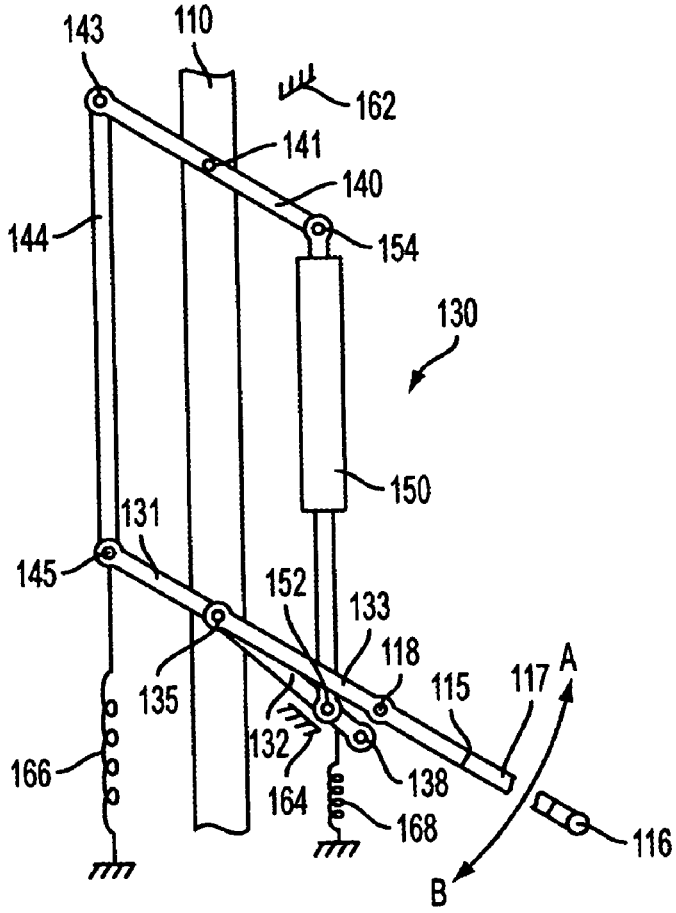
FIG. 6 is a schematic side elevation of a reversible resistance assembly of the present invention utilizing a single-action hydraulic resistance cylinder configured to provide downward exercise resistance force positioned at the end of an exercising stroke.
Figure 7:
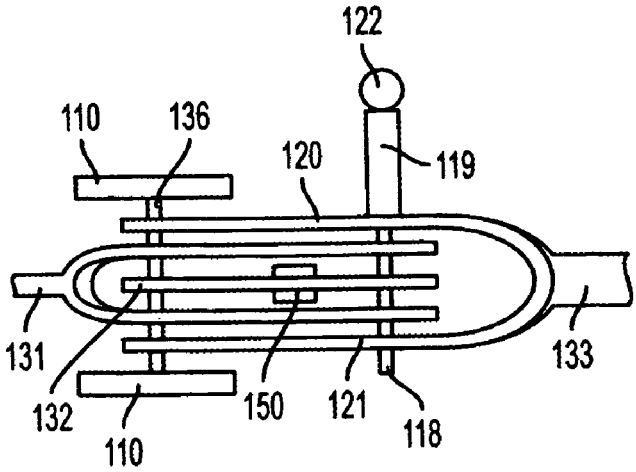
FIG. 7 is a simplified bottom view of the reversible resistance assembly of the exercise apparatus of FIG. 1 configured and positioned as in FIG. 6.

FIG. 7 is a simplified, bottom view of the resistance assembly of the preferred embodiment of the present invention shown in the elevation of FIG. 1 showing only vertical support members 110 and lower lever members in the configuration and position of FIG. 5. Downward exercise resistance force lever member 131, upward exercise resistance force lever member 132 and engagement lever member 133 are supported by axle 136, at lower support member pivotal attachment point 135 shown in FIGS. 1 through 6, between vertical support members 110 which extend upward from mast cap 111. Upper linkage member 140 (not shown) is supported by an axle extending between vertical support members 110 at upper support member pivotal attachment point 141, shown in FIGS. 1 through 6. Downward exercise resistance force lever member 131 has a bifurcated end embracing upward exercise resistance force lever member 132. Engagement lever member 133 has a bifurcated end embracing both lever members 131 and 132. Engagement lever member 133 is provided with engagement pin 118. Engagement pin 118 of the preferred embodiment of FIGS. 1 and 6, is mounted in spring loaded pin sheath 119 attached to bifurcation 120. Spring loaded sheath 119 urges engagement pin 118 to remain extended through an engagement hole defined within bifurcation 121 when in repose. Thus, engagement lever member 133 may be engaged with either of downward exercise resistance force lever member 131 or upward exercise resistance force lever member132 by grasping engagement pin ball 122, drawing engagement pin 118 into sheath 119, appropriately positioning engagement lever member 133 and releasing engagement pin 118 to pass through either of engagement openings 137 defined within the bifurcated end portion of downward exercise resistance force lever member 131 or engagement opening 138 defined within upward exercise resistance force lever member 132. As may be seen in FIGS. 4 and 6, when in repose, each of exercise resistance force lever members 131 and 132 are positioned so as not to interfere with an exercise stroke over the functional range of hydraulic cylinder 150 when the other of exercise resistance levers 131 and 132 is engaged by pin 118.

While an exemplary resistance assembly for a hydraulic resistance exercise apparatus comprising embodiments of the present invention has been shown, it will be understood, of course, that the invention is not limited to this embodiment. Modification may be made by those skilled in the art, particularly in light of the foregoing teachings. For example, while the support members of the exemplary embodiment are vertical, the support members might be arranged in any useful orientation. While the embodiment described in the above specification utilizes a single action hydraulic cylinder which resists compression, the embodiment could be modified to operate with a cylinder that resists only extension by appropriate modification of stops and biasing members. The embodiment might also be modified to operate with elastic extension or compression resistant elements, or with unidirectional resistance sources such as free weights. It is, therefore, contemplated by the appended claims to cover any such modification which incorporates the essential features of this invention or which encompasses the spirit and scope of the invention.

I claim:

1. A resistance assembly for an exercise apparatus comprising:

an elongate vertical support member extending along a support member axis;

a first, elongate exercise resistance lever member extending along a longitudinal axis from a pivot end to a distal exercise end, said pivot end attached to said vertical support member at a lower pivotal attachment point along said support member axis;

a second, elongate exercise resistance lever member extending from a linkage end along a longitudinal axis to a distal exercise end and attached to said vertical support member at said lower pivotal attachment point along said support member longitudinal axis, said attachment point lying on said second exercise lever member longitudinal axis between said linkage end and said exercise end;

an upper linkage member extending along a longitudinal axis from a linkage end to a resistance end and mounted upon said vertical support member at an upper pivotal attachment point on said support member axis above said lower pivotal attachment point, said upper pivotal attachment point lying on said upper linkage member longitudinal axis between said linkage end and said resistance end;

a vertical linkage member extending from a lower vertical linkage member end to an upper linkage member end, said lower vertical linkage member end attached to said second resistance lever member linkage end at a lower vertical linkage member attachment point and said upper vertical linkage member end attached to said upper linkage member linkage end at an upper vertical linkage member attachment point, said upper and lower vertical linkage member attachment points separated one from the other generally by a resistance member spanning distance;

a length change resistance member extending from an upper mounting end along a longitudinal axis to a lower mounting end, said upper mounting end mounted upon said upper linkage member resistance end and said lower mounting end mounted upon said first exercise resistance lever at a mounting point on its longitudinal axis lying beyond said pivot end in the direction of said distal exercise end; and, an exercise engagement lever member including a pivot end attached to said vertical support member and selective exercise lever member engagement means for selectively engaging either of said first exercise resistance lever member at a point along its longitudinal axis beyond said pivot end in the direction of said distal exercise end or said second exercise resistance lever member at a point along its longitudinal axis beyond said lower support member pivotal attachment point in the direction of said distal exercise end.

2. A resistance assembly for an exercise apparatus as in claim 1, further comprising:

said exercise engagement lever member is an elongate exercise lever member extending along a longitudinal axis from a pivot end to a distal exercise end, said pivot end attached to said vertical support member at said lower pivotal attachment point along said support member axis, said distal exercise end including exercise member engagement means for engaging exercise members upon which exercise forces may be exerted and said selective exercise lever member engagement means includes an engagement pin for selectively engaging either of a hole defined within said first exercise resistance lever member or a hole defined within said second exercise resistance lever member.

3. A resistance assembly for an exercise apparatus as in claim 1, further comprising:

said length change resistance member resists compression of said upper mounting end and said lower mounting end along said resistance member longitudinal axis, one toward the other, while allowing generally free extension of said upper mounting end and said lower mounting end along said resistance member longitudinal axis, one away from the other.

4. A resistance assembly for an exercise apparatus as in claim 3, further comprising:

said length change resistance member is a single-action hydraulic cylinder.

5. A resistance assembly for an exercise apparatus as in claim 4, further comprising:

said exercise engagement lever member is an elongate exercise lever member extending along a longitudinal axis from a pivot end to a distal exercise end, said pivot end attached to said vertical support member at said lower pivotal attachment point along said support member axis, said distal exercise end including selective exercise lever member engagement means for engaging exercise resistance lever members upon which exercise forces may be exerted and said selective exercise lever member engagement means includes an engagement pin for selectively engaging either of a hole defined within said first exercise resistance lever member or a hole defined within said second exercise resistance lever member.

6. A resistance assembly for an exercise apparatus as in claim 5, further comprising:

first exercise lever member stop means for preventing said first exercise resistance lever member from rotating beyond a predetermined rotational position about said lower pivotal attachment point.

7. A resistance assembly for an exercise apparatus as in claim 6, further comprising:

first exercise lever member biasing means for urging said first exercise resistance lever member to remain in a rotational position immediately adjacent said first exercise lever member stop means.

8. A resistance assembly for an exercise apparatus as in claim 7, further comprising:

upper linkage member stop means for preventing said upper linkage member from rotating beyond a predetermined rotational position about said upper pivotal attachment point.

9. A resistance assembly for an exercise apparatus as in claim 8, further comprising:

upper linkage member biasing means for urging said upper linkage member to remain in a rotational position immediately adjacent said upper linkage member stop means.

10. A resistance assembly for an exercise apparatus as in claim 9, further comprising:

said second exercise resistance lever member includes a bifurcated potion beginning at a point on said second exercise resistance lever member longitudinal axis lying between said linkage end and said lower pivotal attachment point and extending to said exercise end such that said bifurcated portion may embrace said first exercise resistance lever member.

11. A resistance assembly for an exercise apparatus as in claim 10, further comprising:

said exercise lever engagement member includes a bifurcated portion beginning at a point on said engagement lever longitudinal axis between said distal end and said pivot end, and extending to said pivot end such that said bifurcated portion may embrace both said first exercise resistance lever member and said exercise end of said second exercise resistance lever.

12. A resistance assembly for an exercise apparatus comprising:

a single-action hydraulic cylinder having a longitudinal axis and extending from a first end to a second end, said single-action cylinder providing resistance to compression of one end toward the other end, but providing little resistance to extension of one end away from the other end;

a first compression linkage means for compressing said single-action hydraulic cylinder in response to movement of a first exercise resistance lever in a first direction about an attachment point to a support member;

a second compression linkage means for compressing said single-action hydraulic cylinder in response to movement of a second exercise resistance lever about said attachment point to said support member in a second direction directly opposed to said first direction about said attachment point to said support member; and, an engagement exercise lever assembly including an engagement exercise lever pivotally attached to said support member at said pivotal attachment point and means for selectively engaging said engagement exercise lever to move in fixed relation to one of said first or second exercise levers in both said first and second direction.

13. A resistance assembly for an exercise apparatus as in claim 12, further comprising:

an elongate vertical support member extending along a support member axis; and, said first compression linkage means includes a first, elongate exercise resistance lever member extending along a longitudinal axis from a pivot end to a distal exercise end, said pivot end attached to said vertical support member at a lower pivotal attachment point along said support member axis, and a lower end of said single action hydraulic cylinder is pivotally mounted upon said first exercise resistance lever at a point between said pivot end and said exercise end.

14. A resistance assembly for an exercise apparatus as in claim 13, further comprising:

said second compression linkage means includes a second, elongate exercise resistance lever member extending from a linkage end along a longitudinal axis to a distal exercise end and attached to said vertical support member at said lower pivotal attachment point along said support member longitudinal axis, said lower pivotal attachment point lying on said second exercise lever member longitudinal axis between said linkage end and said exercise end, an upper linkage member extending along a longitudinal axis from a linkage end to a resistance end and pivotally mounted upon said vertical support member at an upper pivotal attachment point on said support member axis above said lower attachment point, said upper pivotal attachment point lying on said upper linkage member longitudinal axis between said linkage end and said resistance end, a vertical linkage member extending from a lower vertical linkage member end to an upper linkage member end, said lower vertical linkage member end attached to said second resistance lever member linkage end at a lower vertical linkage member attachment point and said upper vertical linkage member end attached to said upper linkage member linkage end at an upper vertical linkage member attachment point, said upper and lower vertical linkage member attachment points separated one from the other generally by a hydraulic cylinder spanning distance; and an upper end of said single-action hydraulic cylinder is pivotally mounted upon said upper linkage member resistance end.

15. A resistance assembly for an exercise apparatus as in claim 14, further comprising:

first exercise lever member stop means for preventing said first exercise resistance lever member from rotating beyond a predetermined rotational position about said lower pivotal attachment point.

16. A resistance assembly for an exercise apparatus as in claim 15, further comprising:

first exercise lever member biasing means for urging said first exercise resistance lever member to remain in a rotational position immediately adjacent said first exercise lever member stop means.

17. A resistance assembly for an exercise apparatus as in claim 16, further comprising:

upper linkage member stop means for preventing said upper linkage member from rotating beyond a predetermined rotational position about said upper pivotal attachment point.

18. A resistance assembly for an exercise apparatus as in claim 17, further comprising:

upper linkage member biasing means for urging said upper linkage member to remain in a rotational position immediately adjacent said upper linkage member stop means.

19. A resistance assembly for an exercise apparatus comprising:

unitary direction exercise resistance means for providing exercise resistance to movement in a unitary direction;

first and second exercise resistance lever members, said first and second lever members each pivotally attached to a support member at a pivotal attachment point;

first exercise linkage means for linking said first exercise resistance lever member to said unitary direction exercise resistance means such that said unitary direction exercise resistance means is moved in said unitary direction when said first exercise resistance lever member is moved in a first direction;

second exercise linkage means for linking said second exercise resistance lever member to said unitary direction exercise resistance means such that said unitary direction exercise resistance means is moved in said unitary direction when said second exercise resistance lever member is moved in a second direction opposite said first direction; and engagement exercise lever means including an engagement exercise lever pivotally attached to said support member at said pivotal attachment point and means for selectively engaging one or the other of said first exercise resistance lever and said second exercise resistance lever to move in fixed relation to said engagement exercise lever in both said first and second direction.

* * * * *